US005429043A

United States Patent [19]

Becker

[11] Patent Number: 5,429,043

[45] Date of Patent: Jul. 4, 1995

[54] POWER OPERATED ADJUSTABLE OVEN RACK

[76] Inventor: Ruby Becker, 1021 Olean Rd., East Aurora, N.Y. 14052

[21] Appl. No.: 328,155

[22] Filed: Oct. 24, 1994

[51] Int. Cl.[6] ..... A23L 3/00; A47J 37/00; F24C 15/10; F24C 15/16

[52] U.S. Cl. ..... 99/448; 99/393; 99/450; 126/41 E; 126/337 A

[58] Field of Search ..... 99/393, 443 R, 443 C, 99/448, 449, 450, 427; 126/41 R, 41 E, 41 A–41 C, 25 A, 337 R, 338, 215, 337 A; 248/500; 312/306

[56] References Cited

U.S. PATENT DOCUMENTS

| | | | |
|---|---|---|---|
| 1,657,226 | 1/1928 | Neldner | 312/306 |
| 2,106,506 | 1/1938 | Pletcher et al. | 126/41 |
| 2,473,569 | 6/1949 | Cast | 126/25 A |
| 2,834,334 | 5/1958 | Bill | 99/443 R |
| 2,868,190 | 1/1959 | Reeves | 126/41 |
| 2,919,691 | 1/1960 | Rinaldo et al. | 126/337 A |
| 3,043,290 | 7/1962 | Smith | 312/306 |
| 3,059,634 | 10/1962 | Brinkman et al. | 126/337 |
| 3,552,299 | 1/1971 | Patoka | 99/448 |
| 3,651,796 | 3/1972 | Nelson | 99/450 |
| 3,834,370 | 9/1974 | Nelson | 126/25 A |
| 3,976,000 | 8/1976 | Oxel | 99/393 |
| 4,048,984 | 9/1977 | Eberhardt | 126/337 |
| 4,213,381 | 7/1980 | Ellis | 99/448 |
| 4,926,838 | 5/1990 | Sells et al. | 99/393 |

*Primary Examiner*—Timothy F. Simone
*Attorney, Agent, or Firm*—Franklin J. Cona

[57] ABSTRACT

A power operated system for raising and lowering an oven rack but without opening the oven door is disclosed. The system comprises a plurality of conventional rectangular wire oven shelves in a spaced apart relationship. Each shelf is supported on a protuberance that has a threaded portion that rides up and down a threaded support bar. The support bar is turned by a continuous loop chain gear that derives it's direction from an electric motor. The electric motor is controlled by a remote located switch on the face of the oven. The support bars form a right-angle frame within the oven cavity and are oriented above a lowermost section of the oven which houses the electric motor and the journal bearings they are in.

5 Claims, 6 Drawing Sheets

POWER OPERATED ADJUSTABLE OVEN RACK

BACKGROUND OF THE INVENTION

1. Field of the Invention

The present invention relates to a power operated system for raising and lowering an oven rack, and in particular for raising and lowering an oven rack without opening the oven door.

2. Description of the Background Art

Throughout the United States steps are being taken to improve raising and lowering oven racks without opening the door to eliminate the possibility of burning the cook's hands and forearms. Wire racks are provided for holding baking trays, casserole dishes, corning ware and other devices for cooking and holding food. The typical oven has protuberances or shelf rack guides along the interior wall which form fixed distances between the oven racks themselves. It is left to the cook to determine the appropriate levels of the oven racks when preparing various foods. Typically, and in particular on holidays when many items must be cooked simultaneously, the cook will be faced with the situation of having to relocate the racks relative to each other after the oven has been brought to an operating temperature. In this instance, the cook runs the risk of burning their forearms because it is a cumbersome process to remove partially cooked food and a hot oven rack and relocate the rack at another shelf projection position. The oven racks tend to stick in a position because of the thermal expansion they undergo while the oven is at operating temperature. It is extremely discomforting to the cook to have to go through this process during a baking operation where the food itself is subject to negative consequences when moved during the cooking operation as in a souffle.

U.S. Pat. No. 3,059,634 issued to Brinkman et al. discloses a power operated oven rack having an electric motor to drive an oven shelf rack for selectively raising or lowering the rack and for shifting the rack in and out of the oven compartment. Patent '634 discloses the use of a chain pulley connected to the electric motor to raise and lower the oven shelf in the oven compartment.

U.S. Pat. No. 2,834,334 issued to Bill discloses an oven rack with a raisable shelf portion having a base structure with longitudinal rails to support the oven side walls in a moveable shelf mounted on the frame which is driven by a pantograph linkage which urges movement of the shelf in a vertical direction while maintaining the horizontal orientation of the shelf frame itself. Patent '334 relies solely on the mechanical to raise and lower the shelf in the oven compartment. Patent '334 is silent on the use of a remote controlled electrically driven oven rack.

U.S. Pat. No. 2,919,691 issued to Rinaldo et al. discloses a mechanism for adjusting the height of racks in range ovens. Patent '691 relies solely on the mechanism to raise and lower the shelf in the oven compartment. Patent '691 is silent on the use of a remote controlled electrically driven oven rack.

U.S. Pat. No. 3,043,290 issued to Smith discloses an oven elevating and lowering mechanism having a vertically moveable shelf for holding a cooking pan and a driving assembly to move the shelf in a vertical direction either up or down by means of a remotely controlled electrically powered motor and circuit. Patent '290 uses a worm gear lead screw 34 to move the drive assembly.

U.S. Pat. No. 2,106,506 issued to Pletcher et al. discloses a boiler compartment having a frame and a drawer and a skeleton frame located within adapted to be moved in and out of the oven compartment. Patent '506 relies solely on mechanical means to raise and lower the shelf in the broiler compartment. Patent '506 is silent on the use of a remote controlled electrically driven oven rack.

U.S. Pat. No. 2,868,190 issued to Reeves discloses an adjustable broiler mechanism having a vertically positioned elevator assembly and a horizontally positioned rack pusher assembly to move the rack in the vertical and the horizontal direction. Patent '190 relies solely on mechanical means to raise and lower the shelf in the oven compartment. Patent '190 is silent on the use of a remote controlled electrically driven oven rack.

U.S. Pat. No. 4,048,984 issued to Eberhardt discloses an oven rack having a chain for providing a horizontal movement through a tunnel type oven. The rack is rectangular in shape and has a plurality of axially spaced apart wire rods extending between the sides for supporting baking pans or other articles used in food baking. Patent '984 relies solely on the mechanical wheel to raise and lower the latch in the oven compartment.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore, it is an object of this invention to provide the cook with the means to vary the oven rack height in the oven cavity itself before and during the cooking operation.

Therefore it is an object of the present invention to provide a power operated system for raising and lowering an oven rack without opening the oven door in order to eliminate the cook's hands and forearms.

It is a further object of the invention to provide a power operated system for raising and lowering a plurality of oven racks.

It is a still further object of the invention to provide a power operated system for raising and lowering a plurality of oven racks to an infinite number of systems using a remote controlled apparatus that is located external to the cavity.

It is yet another object of the invention to provide a system for raising and lowering a plurality of oven racks with a minimum of apertures in the oven cavity to reduce the heat loss to the outside environment.

A final object of this invention to be specifically enumerated herein is to provide a Power Operated Oven Rack in accordance with the proceeding objects and which will conform to conventional forms of manufacture, be of simple construction and easy to use so as to provide a device that would be economically feasible, long lasting and relatively trouble free in operation.

Although there have been many inventions related to power operated oven racks none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a power operated system for raising and lowering an oven rack without opening the oven door. The invention comprises a right-angle frame with a plurality of continuously threaded support bars. Each support bar is vertically disposed within a cavity in the oven and supports the oven rack racks as they travel in a vertical directions, either up or down. The oven racks are the conventional rectangular shape and are formed from a plurality of spaced apart wires.

An electric motor is oriented in a lowermost section of the oven below the oven cavity and provides the mode of power to move the oven racks in the vertical direction. The electric motor is activated by a switch that is located on the external panel of the oven. A continuous loop chain gear translates the electrical motor rotation into the threaded support bars which in turn through rotation move the oven racks in the desired vertical. Each support bar has a threaded support nut that moves up and down on the threaded support rod thereby imparting the desired vertical linear motion to the oven racks.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
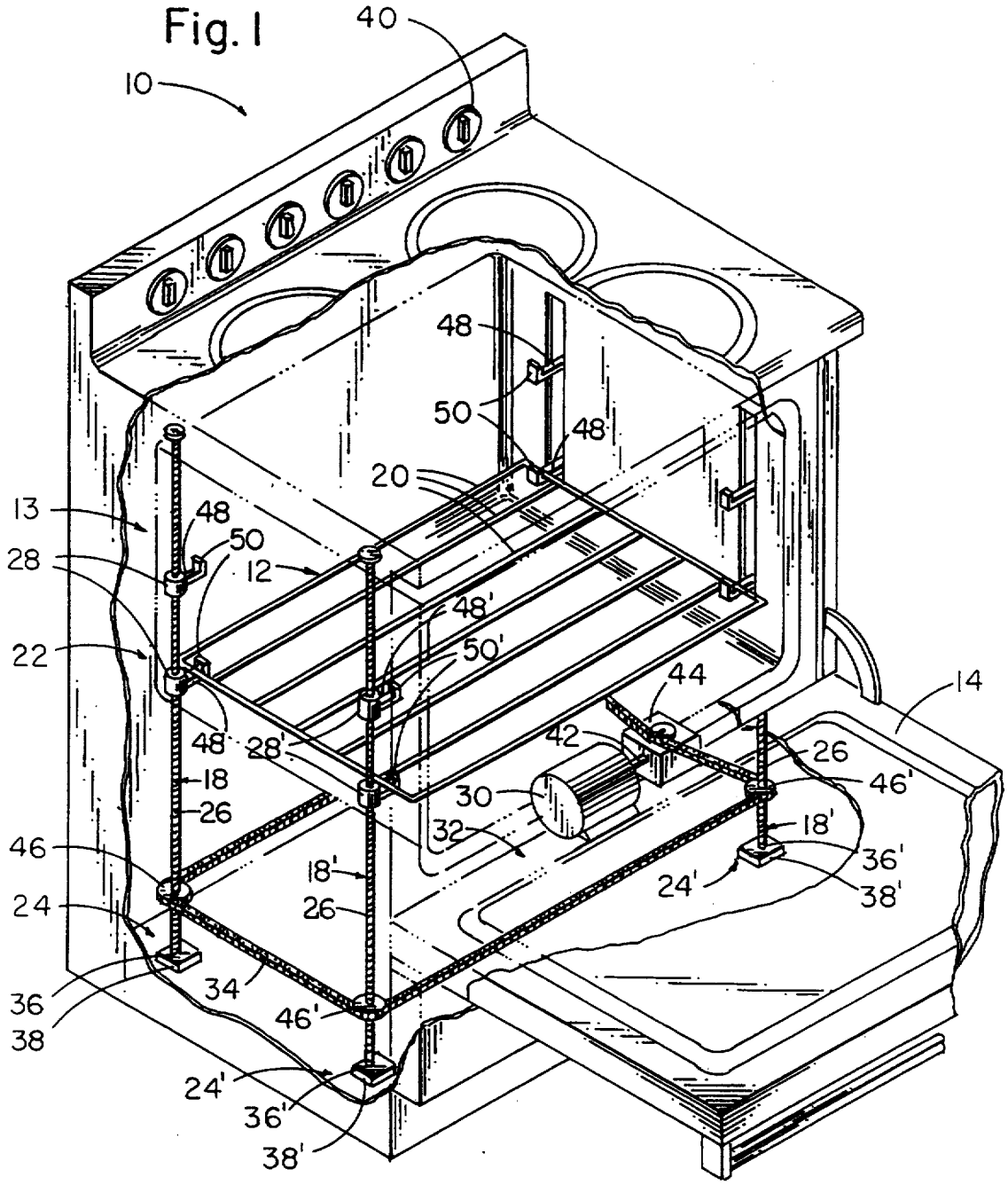
FIG. 1 is a partial cut-away perspective illustration of the continuous loop chain gear embodiment of the invention showing the oven rack and the apparatus to move the racks in a vertical direction.
Figure 3:
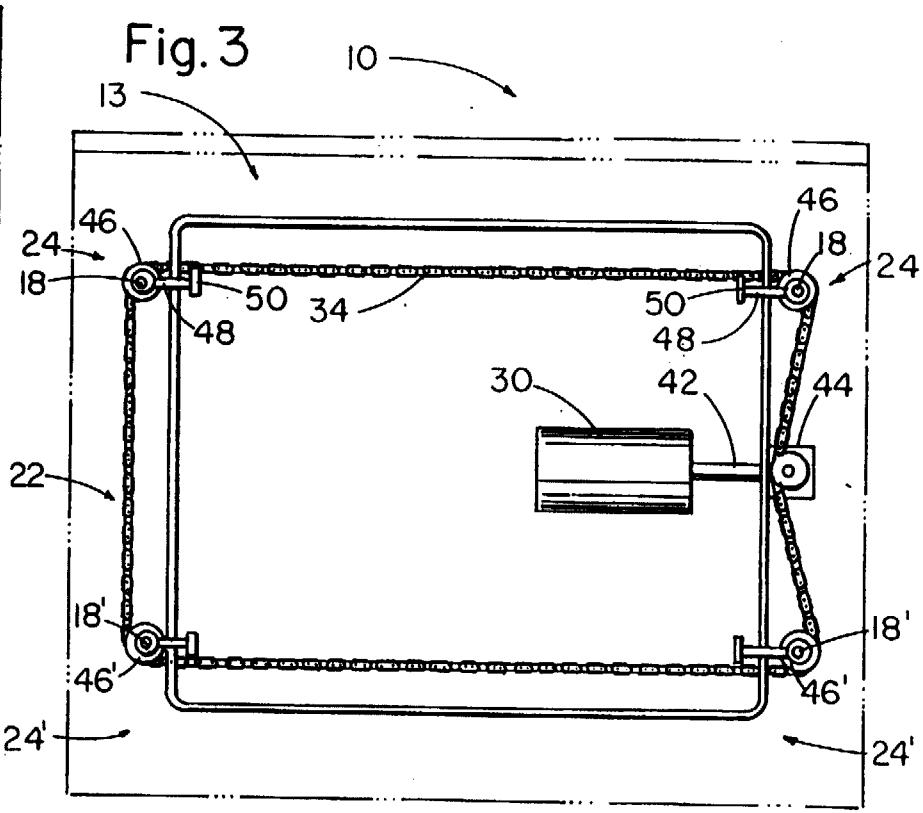
FIG. 3 is a top plan view of the invention as disclosed in FIG. 1.
Figure 2:
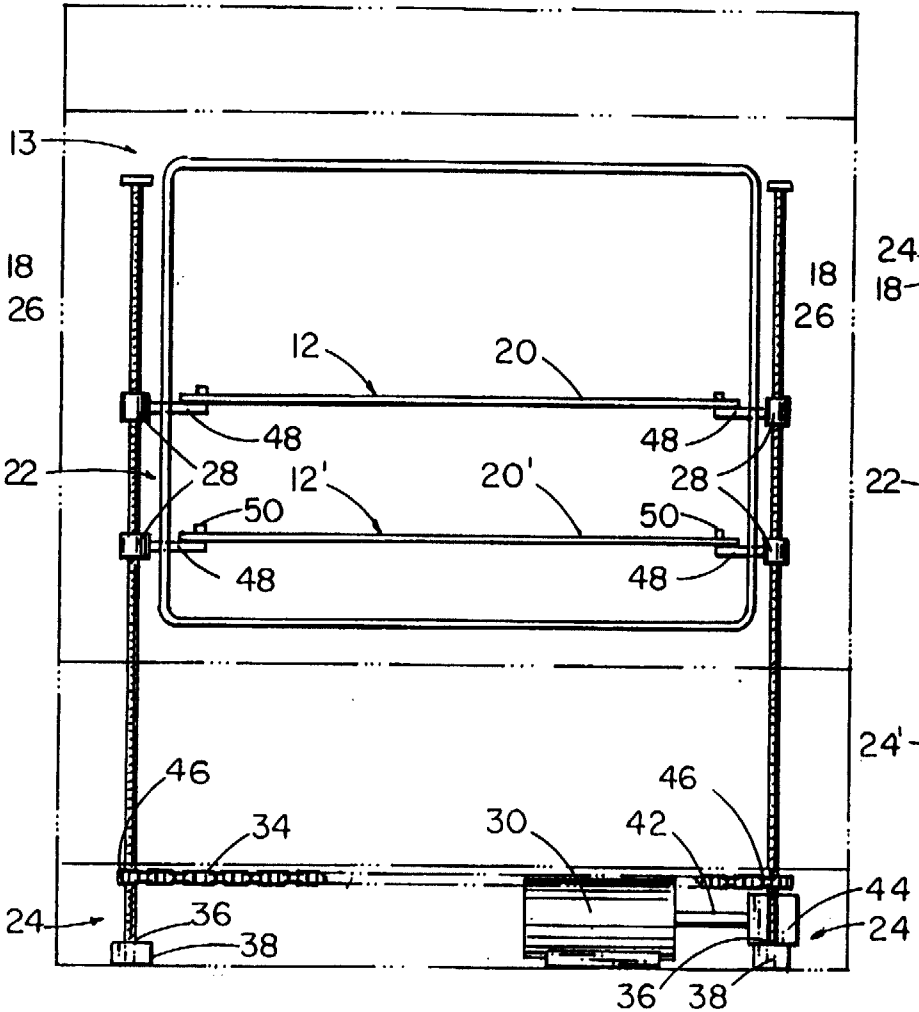
FIG. 2 is a front elevation view of the invention as shown in FIG. 1.
Figure 4:
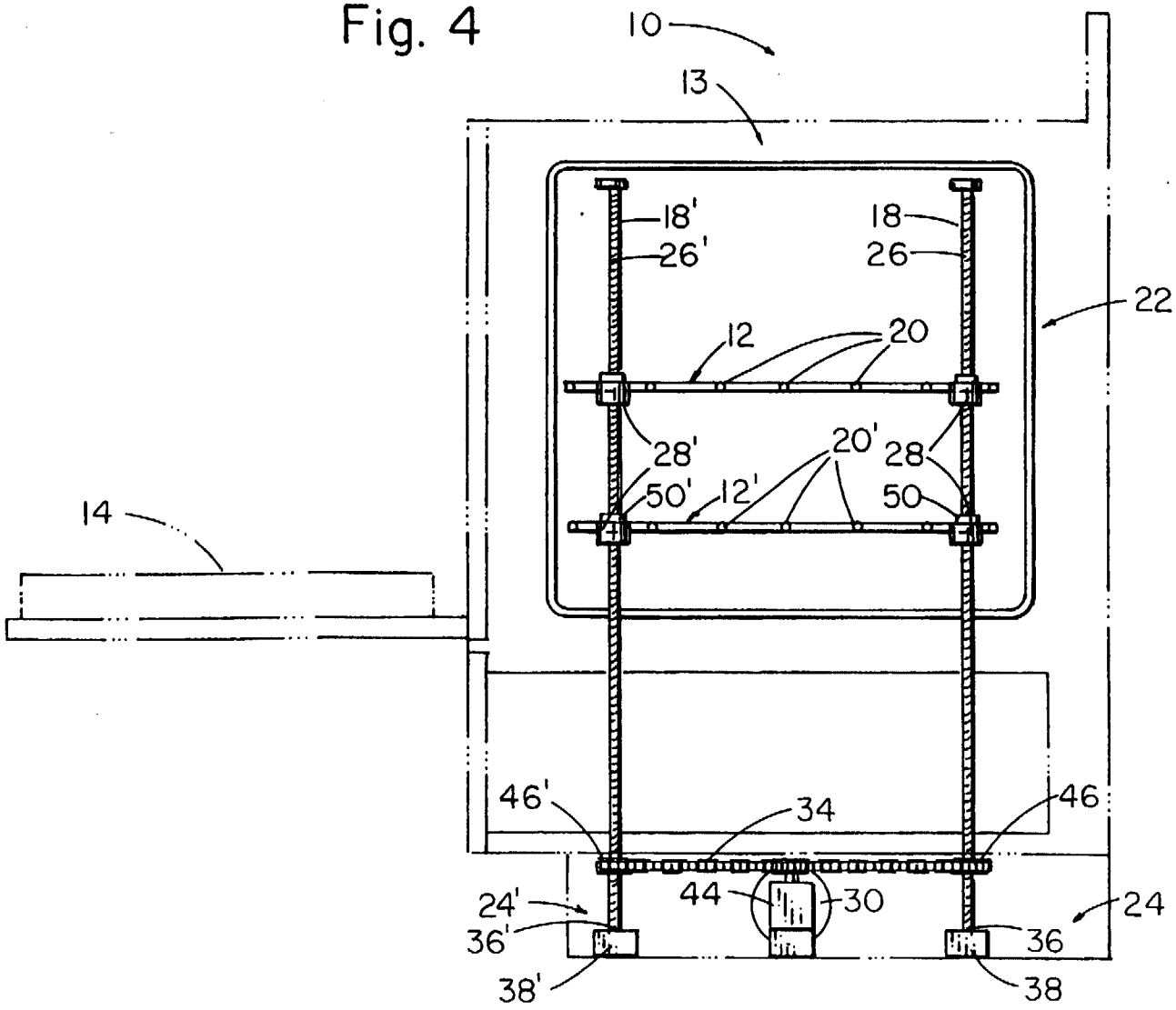
FIG. 4 is a right-side elevation view of the invention as disclosed in FIG. 1.
Figure 5:
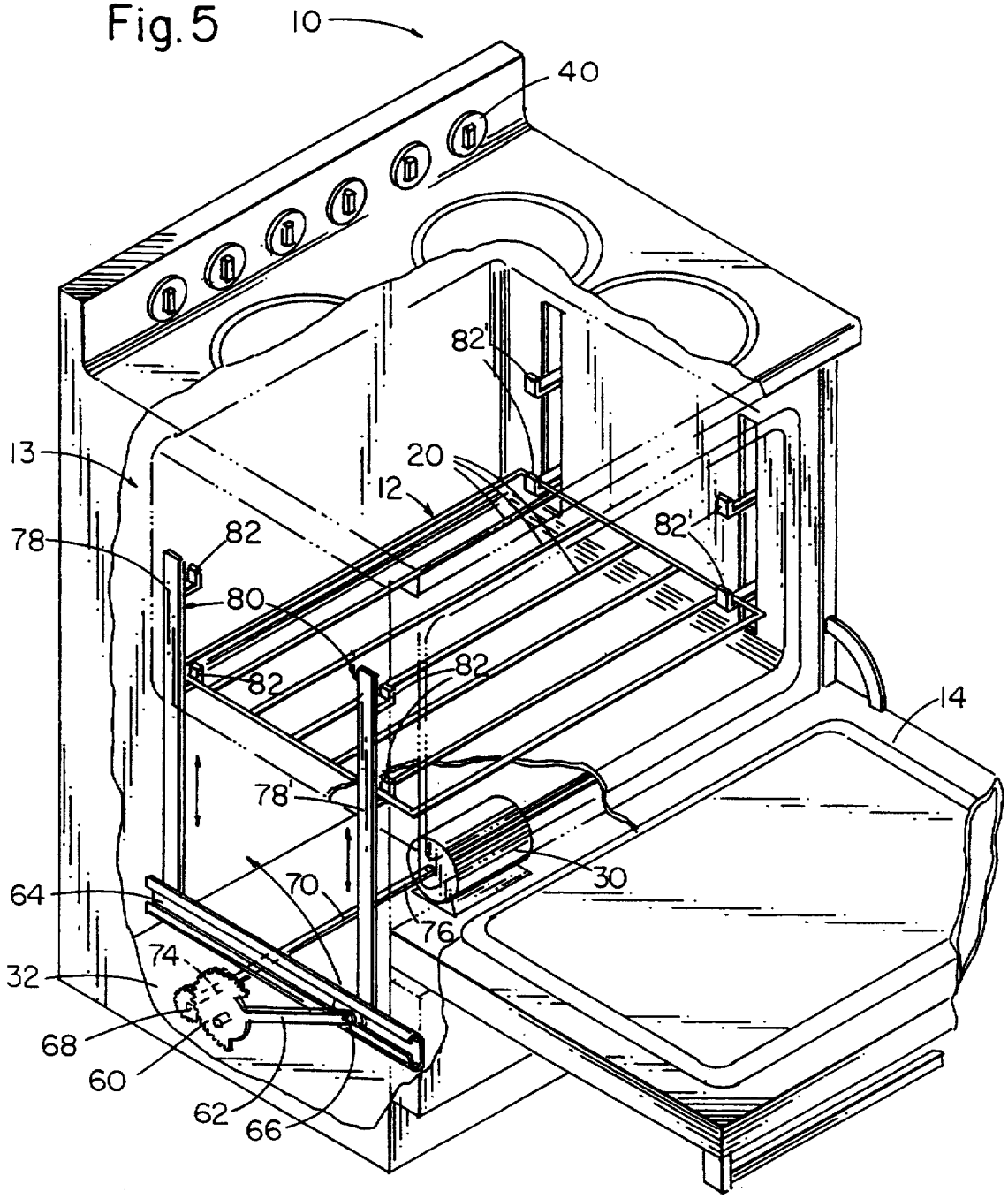
FIG. 5 is a partial cut-away perspective illustration of the lever arm and cam embodiment of the invention showing the oven rack and the apparatus to move the racks in a vertical direction.
Figure 7:
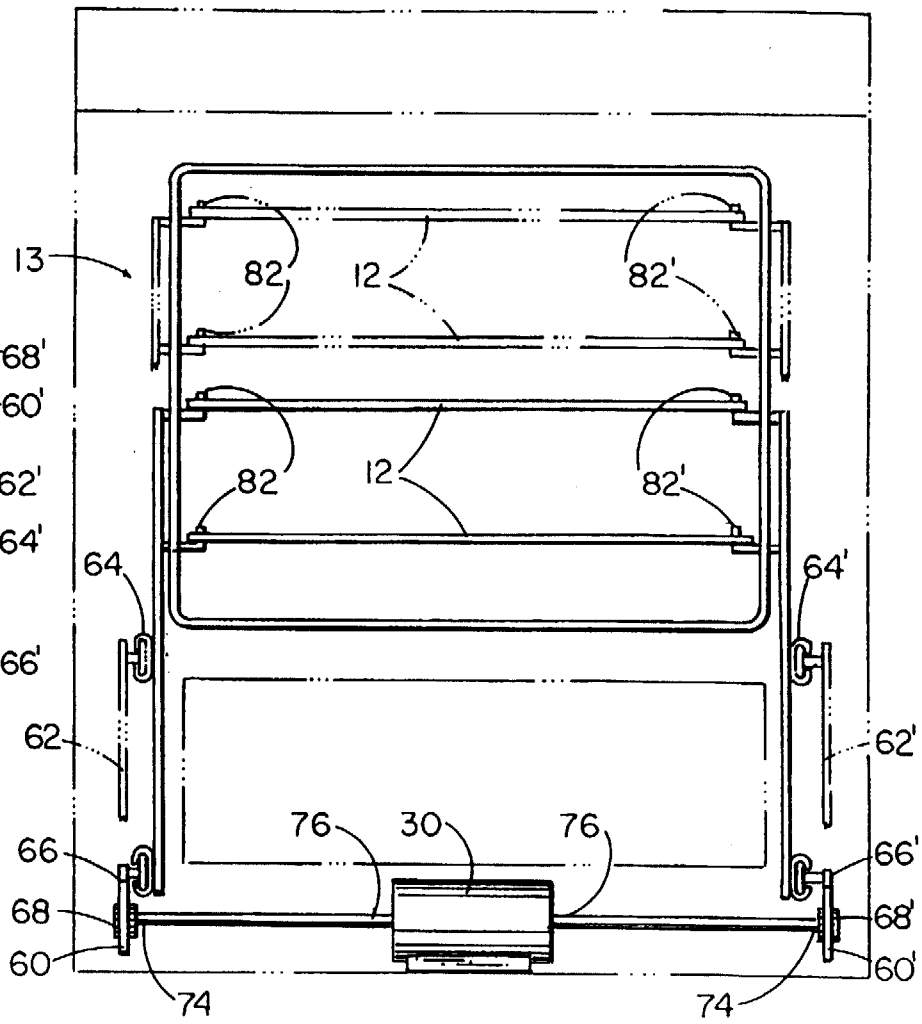
FIG. 7 is a front elevation view of the invention as disclosed in FIG. 5.
Figure 6:
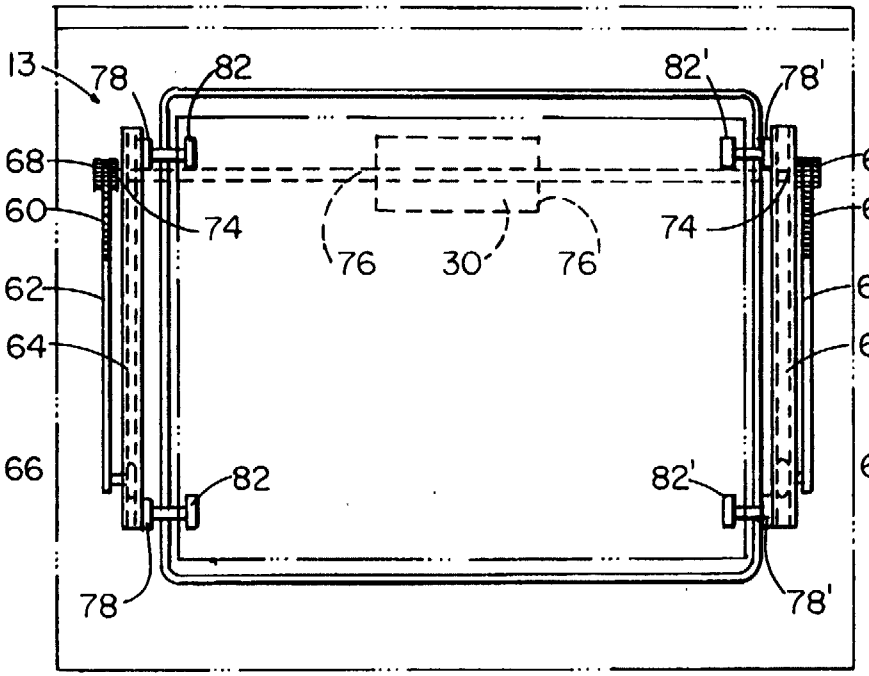
FIG. 6 is a top plan view of the invention as disclosed in FIG. 5.
Figure 8:
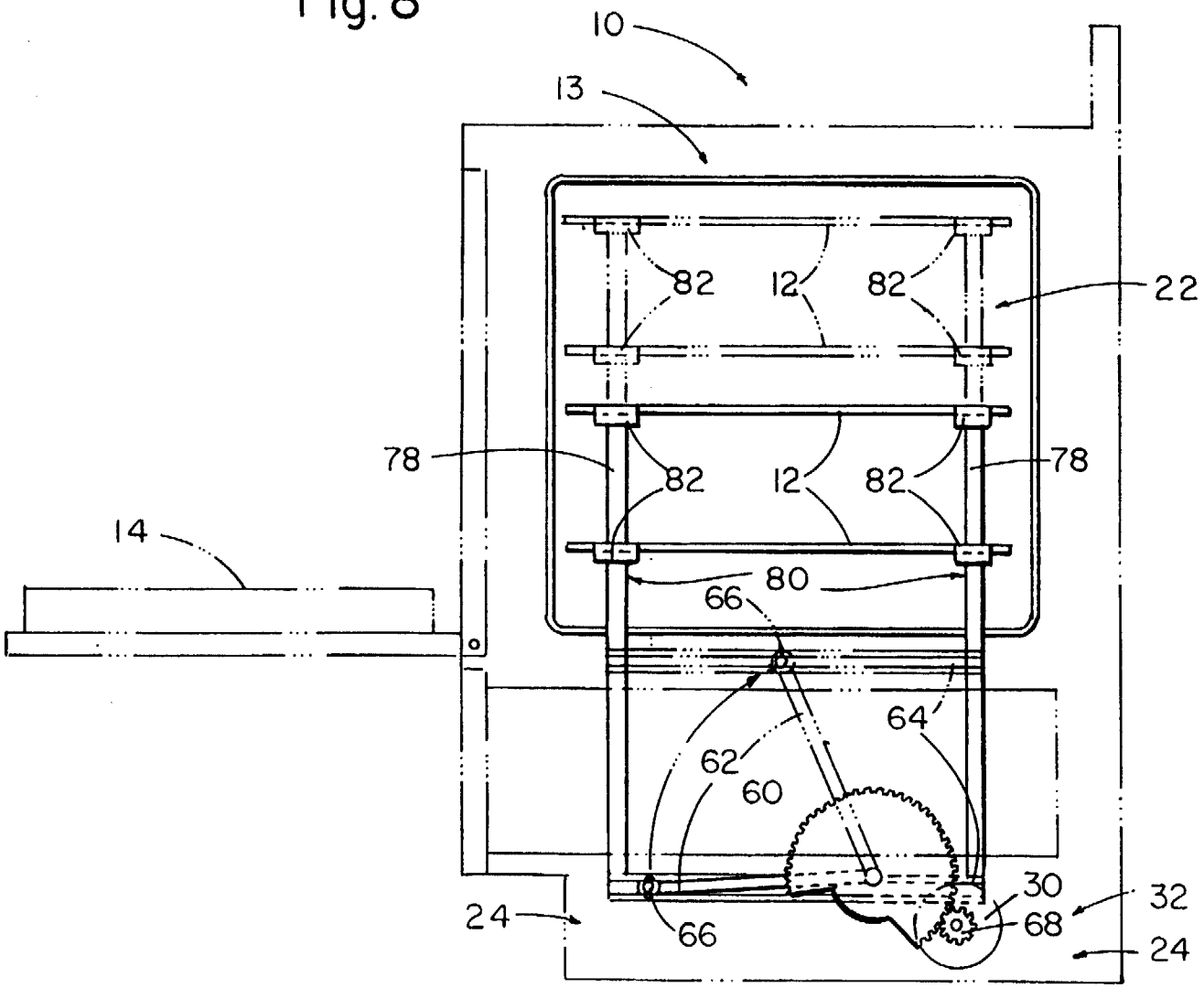
FIG. 8 is a right-hand side view of the invention as disclosed in FIG. 5 showing the cam actuator and the slidable cam follower "C" track.

Referring to FIG. 1, the invention 10 comprises a system for raising and lowering a plurality of oven racks 12, 12' in an oven 13 without opening an oven door 14. The plurality of oven racks 12, 12' are in continuous communication with a plurality of support bars 18, 18' that support each oven rack 16, 16'. Each oven rack is made up from a plurality of wires 20, 20' in a spaced apart relationship that form the conventional oven rack 12 that is typically used everyday in ovens, both electric and gas fired.

The support bars 18, 18' are disposed within an oven cavity 22 at each corner 24, 24' of the cavity 22 in a vertical orientation. Each support bar 18 has a threaded outer periphery 26 that is in continuous threaded communication with an oven rack support nut 28. Each support nut 28, 28' in turn, is in communication with one of the oven racks 12, 12'. Each support nut 28 is moved synchronously up and down the support bar 18 on the threaded outer periphery 26. In this manner, each oven rack 12 is urged to move in a vertical direction, either up or down, but remains level at all times.

A direct current electric motor 30 is disposed in a lowermost section 32 of the oven 13 below the cavity 22. The motor 30 supplies synchronized power to the threaded support bars 18, 18' via a looped continuous chain gear 34. Each support bar 18 has a lower end 36 adapted for bearing communication with a journal 38.

The electric motor 30 is activated by a conventional bipolar DC switch 40 that directs the motor 30 to rotate in a clockwise or counterclockwise direction, depending on whether the user wishes to raise or lower the oven racks 12, 12'.

Rotational motion of the electrical motor 30, whether counterclockwise or clockwise is translated into linear motion via a shaft 42 in a right angle gear box 44 that is also located in the lowermost section 32 of the oven 13. Each support bar 18 has a drive sprocket 46 adapted for chain gear communication with the gear box 44 to synchronize the motion of the plurality of support bars 18, 18' in the vertical direction.

The chain gear 34 is in continuous linked communication with the plurality of sprockets 46, 46' and the right angle gear box 44 in the lowermost section 32 of the oven 13 below the oven cavity 22. Each support nut 28 has an end 48 adapted to receive a pintle 50 that urges the support nut 28 to move in a vertical direction, up and down, on the continuous threaded support bar 18.

A less preferred embodiment of this system utilizes the same oven racks 12, 12', but employs a plurality of gears 60, 60' that are disposed in a rack and pinion relationship with a plurality of follow arms 62, 62' to move the oven racks 12, 12' in a vertical direction whether up or down, within the oven 13. A plurality of tracks 64, 64' are disposed in the lowermost section 32 of the oven 13 in a horizontal, spaced apart relationship and are in slidable contact with a first end 66 of each of the follower arms 62, 62'. Each track 64, 64' translates the rotational motion of the follower arm 62, 62' into vertical linear motion. The electric motor 30 is employed to rotate a plurality of pinion gears 68, 68' in a clockwise or counterclockwise direction, depending on which way the user wishes to move the oven racks 12, 12'. The electric motor 30 is coupled to a shaft 70 in the lowermost section 32 of the oven 13 for transmitting the rotational motion to the pinion gears 68, 68'. The shaft 70 has both ends 72, 74 coupled to one of the pinion gears 68, 68' and a midsection 76 coupled to the electric motor 30. A plurality of support bars 78, 78' forming a right angle frame 80 is disposed vertically for urging the oven racks 12, 12' to move in a vertical direction, either up or down. Each support bar 78, 78' has a plurality of pintles 82, 82' in slidable communication with the plurality of oven racks 12, 12' in a spaced apart, horizontal stacked relationship while they are moving in a vertical direction. The system is controlled by the conventional electric DC bipolar switch 40 to activate the electric motor 30 and move the oven racks 12, 12' in either a clockwise or counterclockwise direction.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A power operated system for raising and lowering an oven rack without opening a door on the oven comprising in combination;

a plurality of oven racks, each rack being rectangular in shape and comprising a plurality of spaced apart wires, each wire attached to the other at an end for forming a rectangular rack;

a right angle frame having a plurality of continuously threaded support bars, each support bar being disposed vertically within a cavity in the oven for urging the oven rack racks to travel in a vertical direction, either up or down;

electric motor means disposed in a lowermost section of the oven below the oven cavity, and further being in chain gear communication with each continuously threaded support bar for urging clockwise or counterclockwise rotation for each support bar;

a plurality of journal bearings disposed in the lowermost section of the oven below the oven cavity, each journal bearing further being in support communication with one of the continuously threaded support bars;

a plurality of oven rack support nuts, each support nut being in threadable communication with one of the continuously threaded support bars, and each support nut further being in removable communication with an oven rack for urging the oven rack to move in a vertical direction, either up or down; and electric control means for activating the electric motor in either a clockwise or a counterclockwise direction.

2. A power operated system for raising and lowering an oven rack as recited in claim 1 wherein the electric motor means further includes a shaft and a right angle gear box and a plurality of driven sprockets, the right angle gear box for translating horizontal rotation of the shaft into vertical rotation for each driven sprocket.

3. A power operated system for raising and lowering an oven rack as recited in claim 2 and further including a continuous link chain gear being horizontally disposed in the lowermost section of the oven below the oven cavity, and further being in continuous chain gear communication with each driven sprocket and the electric motor for urging synchronized rotation of each continuously threaded support bar within each support nut.

4. A power operated system for raising and lowering an oven rack as recited in claim 1 wherein each support nut further includes a plurality of pintles for urging vertical movement of the support nut on the continuously threaded support bar prior to placing the oven rack in the oven cavity.

5. A power operated system for raising and lowering an oven rack for use in an oven without opening a door on the oven comprising in combination;

a plurality of oven racks, each oven rack being rectangular in shape and comprising a plurality of wires having an end attached to the other at each end for forming a rectangular rack;

a plurality of gears disposed in a rack and pinion relationship and further having a plurality of follower arms for urging the oven rack to move in a vertical direction within the oven;

a plurality of tracks disposed in a lower section of the oven in a horizontal spaced apart relationship, and further, each track being in slidable contact with a first end of each of the follower arms for translating rotational motion of the follower arm into vertical linear motion of the tracks;

electric motor means for rotating the plurality of pinion gears in a clockwise or counterclockwise direction;

a shaft having a mid-section coupled to the electric motor and disposed transversely in the lower section of the oven, and further having each end coupled to one of the pinion gears;

a right angle support frame having a plurality of support bars, each support bar being disposed vertically for urging the oven racks to move in a vertical direction, either up or down;

a plurality of support pintles, each pintle being slidably coupled to each support bar for holding the oven racks while the oven racks are moving in a vertical direction, either up or down; and electric control means for activating the electric motor in either a clockwise or a counterclockwise direction.

* * * * *